US010455875B2

(12) United States Patent
Boorsma et al.

(10) Patent No.: US 10,455,875 B2
(45) Date of Patent: Oct. 29, 2019

(54) CUT, ABRASION AND/OR PUNCTURE RESISTANT KNITTED GLOVES

(71) Applicant: Higher Dimension Materials, Inc., Oakdale, MN (US)

(72) Inventors: James Boorsma, St. Paul, MN (US); Nicole Smith, Roseville, MN (US)

(73) Assignee: HIGHER DIMENSION MATERIALS, INC., Oakdale, MN (US)

( * ) Notice: Subject to any disclaimer, the term of this patent is extended or adjusted under 35 U.S.C. 154(b) by 126 days.

(21) Appl. No.: 15/230,028

(22) Filed: Aug. 5, 2016

(65) Prior Publication Data

US 2017/0055608 A1 Mar. 2, 2017

Related U.S. Application Data

(62) Division of application No. 12/134,862, filed on Jun. 6, 2008.

(60) Provisional application No. 60/942,377, filed on Jun. 6, 2007.

(51) Int. Cl.
*A41D 19/015* (2006.01)
*A41D 19/04* (2006.01)

(52) U.S. Cl.
CPC ..... *A41D 19/01505* (2013.01); *A41D 19/04* (2013.01); *A41D 2500/10* (2013.01)

(58) Field of Classification Search
CPC ..... A41D 19/01505; A41D 19/04; A41D 2500/10; A41D 19/015
See application file for complete search history.

(56) References Cited

U.S. PATENT DOCUMENTS

| | | | |
|---|---|---|---|
| 358,245 | A | 2/1887 | Arnett |
| 389,608 | A | 9/1888 | Skinner |
| 1,495,146 | A | 5/1924 | Ariente et al. |
| 1,758,296 | A | 3/1930 | Schaumann |
| 2,893,314 | A | 7/1959 | Gore |
| 3,175,331 | A | 3/1965 | Klein |

(Continued)

FOREIGN PATENT DOCUMENTS

| | | |
|---|---|---|
| CH | 273660 | 2/1951 |
| CN | 1235008 A | 11/1999 |

(Continued)

OTHER PUBLICATIONS

Examination Report from counterpart European Application No. 08770361.7-1705, dated Oct. 22, 2015, 5 pp.

(Continued)

*Primary Examiner* — James Mellott
(74) *Attorney, Agent, or Firm* — Shumaker & Sieffert, P.A.

(57) ABSTRACT

An improved protective knitted glove assembly includes a knitted glove and two or more non-coplanar arrays of printed guard plates. The guard plates are small, regularly-spaced, generally uniform thickness, non-overlapping, hard polymer material members arranged in a predetermined pattern having an area parallel to a surface of the glove with major and minor dimensions. The major dimension to minor dimension aspect ratio of the guard plates is between about 3 and 1. The overall abrasion resistance of the glove assembly is substantially greater than an abrasion resistance of the knitted glove without the guard plates.

7 Claims, 12 Drawing Sheets

(56) References Cited

U.S. PATENT DOCUMENTS

| | | | |
|---|---|---|---|
| 3,179,551 | A | 4/1965 | Dudas |
| 3,227,574 | A | 1/1966 | Mohr |
| 3,553,066 | A | 1/1971 | Cavalier et al. |
| 3,633,216 | A | 1/1972 | Schinholtz |
| 3,641,719 | A | 2/1972 | Yang |
| 3,711,889 | A | 1/1973 | Jennings |
| 3,813,281 | A | 5/1974 | Burgess et al. |
| 3,867,239 | A | 2/1975 | Alesi et al. |
| 3,867,727 | A | 2/1975 | Povlacs |
| 3,894,472 | A | 7/1975 | Davis |
| 3,925,034 | A | 12/1975 | Anna et al. |
| 4,038,836 | A | 8/1977 | Rose |
| 4,055,029 | A | 10/1977 | Kalbow |
| 4,082,878 | A | 4/1978 | Boe et al. |
| 4,104,095 | A | 8/1978 | Shaw |
| 4,142,334 | A | 3/1979 | Kirsch et al. |
| 4,142,434 | A | 3/1979 | Gross |
| 4,173,199 | A | 11/1979 | Fassina |
| 4,190,550 | A | 2/1980 | Campbell |
| 4,292,882 | A | 10/1981 | Clausen |
| 4,313,379 | A | 2/1982 | Wallace |
| 4,315,379 | A | 2/1982 | Lang |
| 4,319,944 | A | 3/1982 | Pope |
| 4,352,846 | A | 10/1982 | Passier et al. |
| 4,442,150 | A | 4/1984 | Greiner et al. |
| 4,548,852 | A | 10/1985 | Mitchell |
| 4,569,874 | A | 2/1986 | Kuznetz |
| 4,600,620 | A | 7/1986 | Lloyd et al. |
| 4,603,069 | A | 7/1986 | Haq et al. |
| 4,623,574 | A | 11/1986 | Harpell et al. |
| 4,636,423 | A | 1/1987 | Reid |
| 4,728,538 | A | 3/1988 | Kaspar et al. |
| 4,742,578 | A | 5/1988 | Seid |
| 4,793,354 | A | 12/1988 | Wright et al. |
| 4,810,559 | A | 3/1989 | Fortier et al. |
| 4,833,733 | A | 5/1989 | Welch et al. |
| 4,858,245 | A | 8/1989 | Sullivan et al. |
| 4,861,666 | A | 8/1989 | LeGrand et al. |
| 4,864,661 | A | 9/1989 | Gimbel |
| 4,881,277 | A | 11/1989 | Hogle |
| 4,882,905 | A | 11/1989 | Kawamura |
| 4,894,991 | A | 1/1990 | Kawamura |
| 4,901,372 | A | 2/1990 | Pierce |
| 4,901,530 | A | 2/1990 | Kawamura |
| 4,916,000 | A | 4/1990 | Li et al. |
| 4,919,966 | A | 4/1990 | Shlenker |
| 4,949,417 | A | 8/1990 | Wertz et al. |
| 4,995,119 | A | 2/1991 | Codkind |
| 5,020,162 | A | 6/1991 | Kersten et al. |
| 5,070,540 | A | 12/1991 | Betcher et al. |
| 5,070,543 | A | 12/1991 | Beck |
| 5,072,453 | A | 12/1991 | Widder |
| 5,087,499 | A | 2/1992 | Sullivan |
| 5,087,516 | A | 2/1992 | Groves |
| 5,093,933 | A | 3/1992 | Berry |
| 5,132,167 | A | 7/1992 | Prato |
| 5,138,719 | A | 8/1992 | Orlianges et al. |
| 5,156,900 | A | 10/1992 | Nishimura |
| 5,172,424 | A | 12/1992 | Adkins |
| 5,173,966 | A | 12/1992 | DeLeo |
| 5,187,023 | A | 2/1993 | Prevorsek et al. |
| 5,187,815 | A | 2/1993 | Stern et al. |
| 5,196,252 | A | 3/1993 | Harpell et al. |
| 5,200,263 | A | 4/1993 | Gould et al. |
| 5,210,877 | A | 5/1993 | Newman |
| 5,213,588 | A | 5/1993 | Wong et al. |
| 5,231,700 | A | 8/1993 | Cutshall |
| 5,259,069 | A | 11/1993 | Gimbel |
| 5,306,532 | A | 4/1994 | Tsien et al. |
| 5,308,683 | A | 5/1994 | Dees, Jr. et al. |
| 5,310,590 | A | 5/1994 | Tochacek et al. |
| 5,317,759 | A | 6/1994 | Pierce |
| 5,335,373 | A | 8/1994 | Dangman et al. |
| 5,336,555 | A | 8/1994 | Darras et al. |
| 5,345,612 | A | 9/1994 | Stein |
| D351,930 | S | 10/1994 | Snider et al. |
| 5,357,636 | A | 10/1994 | Dresdner, Jr. et al. |
| 5,362,527 | A | 11/1994 | Harpell et al. |
| 5,366,523 | A | 11/1994 | Rowenhorst et al. |
| 5,368,930 | A | 11/1994 | Samples |
| 5,407,612 | A | 4/1995 | Gould et al. |
| D358,145 | S | 5/1995 | DeLeo |
| D358,245 | S | 5/1995 | DeLeo |
| 5,418,044 | A | 5/1995 | Mahler |
| 5,421,033 | A | 6/1995 | DeLeo |
| 5,423,090 | A | 6/1995 | Gimbel |
| 5,425,142 | A | 6/1995 | Scott |
| 5,428,841 | A | 7/1995 | Stein |
| 5,429,678 | A | 7/1995 | Fany |
| 5,442,815 | A | 8/1995 | Cordova et al. |
| 5,442,816 | A | 8/1995 | Seketa |
| 5,448,777 | A | 9/1995 | Lew |
| 5,459,879 | A | 10/1995 | Fuchs |
| 5,500,957 | A | 3/1996 | Stein |
| 5,503,899 | A | 4/1996 | Ashida et al. |
| 5,511,241 | A | 4/1996 | Ziegler |
| 5,515,548 | A | 5/1996 | Lazarus |
| 5,543,004 | A | 8/1996 | Tochacek et al. |
| 5,548,844 | A | 8/1996 | Ceresia |
| 5,564,127 | A | 10/1996 | Manne |
| 5,568,657 | A | 10/1996 | Cordova et al. |
| 5,569,348 | A | 10/1996 | Hefele |
| 5,575,296 | A | 11/1996 | Peck |
| 5,591,239 | A | 1/1997 | Larson et al. |
| 5,601,895 | A | 2/1997 | Cunningham |
| 5,609,431 | A | 3/1997 | Carroll |
| 5,625,900 | A | 5/1997 | Hayes |
| 5,626,949 | A | 5/1997 | Blauer et al. |
| 5,632,948 | A | 5/1997 | Moore |
| 5,644,797 | A | 7/1997 | Daneshvar |
| 5,665,810 | A | 9/1997 | Patchett et al. |
| 5,671,489 | A | 9/1997 | Salach |
| 5,671,498 | A | 9/1997 | Martin et al. |
| 5,677,029 | A | 10/1997 | Prevorsek et al. |
| 5,685,935 | A | 11/1997 | Heyer et al. |
| 5,687,424 | A | 11/1997 | Masley |
| 5,697,762 | A | 12/1997 | Thompson et al. |
| D389,608 | S | 1/1998 | Kraatz |
| 5,706,520 | A | 1/1998 | Thornton et al. |
| 5,709,920 | A | 1/1998 | Danton |
| 5,745,919 | A | 5/1998 | Kraatz |
| 5,752,279 | A | 5/1998 | Hochmuth |
| 5,759,626 | A | 6/1998 | Hefele |
| 5,761,743 | A | 6/1998 | Andrews et al. |
| 5,765,559 | A | 6/1998 | Kim |
| 5,773,373 | A | 6/1998 | Wynne et al. |
| 5,786,065 | A | 7/1998 | Annis et al. |
| 5,789,327 | A | 8/1998 | Rousseau |
| 5,799,333 | A | 9/1998 | McGarry et al. |
| 5,814,388 | A | 9/1998 | Fryan |
| 5,839,842 | A | 11/1998 | Wanat et al. |
| 5,853,863 | A | 12/1998 | Kim |
| 5,854,143 | A | 12/1998 | Schuster et al. |
| 5,855,991 | A | 1/1999 | Mclarty, III |
| 5,863,306 | A | 1/1999 | Wei et al. |
| 5,883,021 | A | 3/1999 | Beer et al. |
| 5,906,873 | A | 5/1999 | Kim |
| 5,914,082 | A | 6/1999 | Harrison |
| 5,925,441 | A | 7/1999 | Blauer et al. |
| 5,935,678 | A | 8/1999 | Park |
| 5,953,751 | A | 9/1999 | Kobren |
| 5,955,417 | A | 9/1999 | Taylor |
| 5,965,235 | A | 10/1999 | McGuire et al. |
| 6,000,005 | A | 12/1999 | Yamada |
| 6,000,055 | A | 12/1999 | Citterio |
| 6,007,590 | A | 12/1999 | Sanders, Jr. |
| 6,020,057 | A | 2/2000 | Darras |
| 6,044,493 | A | 4/2000 | Post |
| 6,044,494 | A | 4/2000 | Kang |
| 6,080,474 | A | 6/2000 | Oakley et al. |
| 6,087,279 | A | 7/2000 | Laun |
| 6,159,590 | A | 12/2000 | Kim |
| 6,175,962 | B1 | 1/2001 | Michelson |
| 6,192,543 | B1 | 2/2001 | Lee |

(56) References Cited

U.S. PATENT DOCUMENTS

| | | | | |
|---|---|---|---|---|
| 6,227,574 | B1 | 5/2001 | Mohr | |
| 6,299,817 | B1 * | 10/2001 | Parkinson | A43B 1/10 12/142 E |
| 6,312,484 | B1 | 11/2001 | Chou et al. | |
| 6,370,694 | B1 | 4/2002 | Michelson | |
| 6,383,614 | B1 | 5/2002 | Carson et al. | |
| 6,391,806 | B1 | 5/2002 | Carson et al. | |
| 6,591,427 | B1 | 7/2003 | Bennett | |
| 6,592,983 | B1 | 7/2003 | Carson et al. | |
| 6,787,487 | B1 | 9/2004 | Takeda et al. | |
| 6,962,739 | B1 | 11/2005 | Kim et al. | |
| 7,018,692 | B2 | 3/2006 | Kim et al. | |
| 7,229,670 | B2 | 6/2007 | Williams | |
| 7,758,296 | B2 | 7/2010 | Borchers et al. | |
| 2002/0053108 | A1 | 5/2002 | Goyarts | |
| 2002/0106953 | A1 | 8/2002 | Kim et al. | |
| 2003/0124935 | A1 | 7/2003 | Smith et al. | |
| 2004/0192133 | A1 | 9/2004 | Kim et al. | |
| 2005/0009429 | A1 | 1/2005 | Park et al. | |
| 2005/0170221 | A1 | 8/2005 | Kim et al. | |
| 2005/0177923 | A1 | 8/2005 | Simic | |
| 2005/0268374 | A1 * | 12/2005 | Mattesky | A41D 19/01523 2/164 |
| 2007/0031601 | A1 * | 2/2007 | Williams | A41D 19/01547 427/282 |
| 2007/0039083 | A1 * | 2/2007 | Williams | A41D 19/0003 2/16 |
| 2007/0212965 | A1 | 9/2007 | Smith et al. | |
| 2009/0007313 | A1 | 1/2009 | Boorsma et al. | |
| 2009/0139011 | A1 | 6/2009 | VanErmen et al. | |
| 2009/0142535 | A1 | 6/2009 | Kim et al. | |

FOREIGN PATENT DOCUMENTS

| | | | |
|---|---|---|---|
| DE | 2536440 | | 2/1977 |
| DE | 2927653 | | 1/1981 |
| DE | 3718453 | | 12/1988 |
| DE | 3938741 | | 3/1991 |
| EP | 0028476 | | 5/1981 |
| EP | 0053201 | | 6/1982 |
| EP | 0441622 | A1 | 4/1991 |
| EP | 0657110 | | 6/1995 |
| FR | 2315897 | | 3/1979 |
| FR | 2699265 | | 6/1994 |
| GB | 787798 | | 12/1957 |
| GB | 2130073 | | 5/1984 |
| GB | 2238460 | | 6/1991 |
| GB | 2287639 | | 9/1995 |
| GB | 2302794 | | 2/1997 |
| IT | 737334 | | 5/1905 |
| JP | 5667958 | | 10/1954 |
| JP | 57131258 | | 2/1956 |
| JP | 4728079 | | 10/1972 |
| JP | 48103224 | | 12/1973 |
| JP | 52062502 | | 5/1977 |
| JP | 58171266 | | 10/1983 |
| JP | 5939168 | | 3/1984 |
| JP | 6332764 | | 3/1988 |
| JP | 6341470 | | 3/1988 |
| JP | 63131357 | | 8/1988 |
| JP | 63285503 | | 11/1988 |
| JP | 01103224 | | 4/1989 |
| JP | 4261778 | | 9/1992 |
| JP | 6278040 | | 10/1994 |
| JP | H073655 | A | 1/1995 |
| JP | 271453 | U | 5/1995 |
| JP | 8120574 | | 5/1996 |
| JP | 10264315 | A | 10/1998 |
| JP | 200088497 | A | 3/2000 |
| JP | 2000178884 | A | 6/2000 |
| JP | 2000328328 | A | 11/2000 |
| JP | 2000343442 | | 12/2000 |
| JP | 2002013014 | A | 1/2002 |
| JP | 2002201515 | A | 7/2002 |
| JP | 200349306 | | 2/2003 |
| WO | 9321492 | | 4/1992 |
| WO | 9208094 | | 5/1992 |
| WO | 9220519 | | 11/1992 |
| WO | 9220520 | | 11/1992 |
| WO | 9507033 | | 3/1995 |
| WO | 9607509 | | 3/1996 |
| WO | 9800039 | | 1/1998 |
| WO | 98/30625 | | 7/1998 |
| WO | 9853715 | | 12/1998 |
| WO | 0210667 | | 7/2000 |
| WO | 0076430 | | 12/2000 |
| WO | 0129299 | | 4/2001 |
| WO | 03057462 | | 7/2003 |

OTHER PUBLICATIONS

3M Purchase Orders, 2003-2004.

Cooking Pleasures, Product test report synopsis, 2003.

Official Action issued by the Korean Intellectual Property Office (KIPO) and English translation of the rejections for corresponding Korean application No. 7000174/2010, dated Aug. 9, 2011, I pp.

The Notification Concerning Transmittal of International Preliminary Report on Patentability (Chapter I ofthe Patent Cooperation Treaty) from corresponding PCT Application Serial No. PCT/US2008/066146, dated Dec. 17, 2009, 8 pages.

Extended European Search Report from corresponding European application No. 08770361.7, dated Feb. 29, 2012, 6 pp.

First Examination Report from counterpart Indian Application No. 7156/CHENP/2009, dated Mar. 12, 2015, 2 pp.

International Search Report and Written Opinion issued in PCT/US2008/066146, dated Sep. 25, 2008, 10 pages.

Invitation to Respond to Written Opinion dated May 26, 2010 from the Intellectual Property Office of Singapore and Written Opinion from the Hungarian Patent Office for corresponding Singapore patent application No. 200908111-8, dated Apr. 15, 2010, 10 pages.

Invitation to Respond to Written Opinion from the Intellectual Property Office of Singapore and Written Opinion issued by the Hungarian Patent Office dated Jan. 18, 2011 for corresponding Singapore patent application 200908111-8, dated Jan. 21, 2011, 14 pages.

Notice of Reasons for Rejection, and translation thereof, from counterpart Japanese Patent Application No. 2014-027583, dated Mar. 3, 2015, 5 pp.

Office Action for counterpart Chinese application No. 200880019201.9. dated May 25. 2012. 8 pp.

Office Action from Chinese application No. 200880019201.9, dated Dec. 6, 2011, 8 pp.

Office Action from Chinese patent application No. 200880019201.9, dated Mar. 29, 2011, 12 pp.

Office Action from counterpart Japanese patent application No. 2010-511371, dated Nov. 6. 2012. 7 pp.

Office Action from Japanese application No. 2010-511371, dated Nov. 15, 2011, 10 pp.

Reply to Communication pursuant to Art. 94(3) from counterpart European Application No. 08770361.7, filed Feb. 25, 2016, 11 pp.

Response to Search Report dated Mar. 9. 2012. from corresponding European application No. 38770361.7-1256, filed Sep. 26,2012, 12 pp.

Prosecution History from U.S. Appl. No. 12/134,82 dated Jun. 23, 2011 through Nov. 25, 2013, 112 pp.

Definition "liquid" WhatIs, whatis.techtarget.com/definition/liquid, accessed on or about Sep. 2005, 12 pp.

Definition "liquid" Wikipedia, https://en.wikipedia.org/wiki/Liquid, accessed on or about May 9, 2016, 9 pp.

Definition of "Distribute," Merriam-Webster Dictionary, http:www.merriam-webster.com/dictionary/distribute, retrieved on Jan. 13, 2017, 1 pp.

Definition of "pattern", Merriam-Webster Dictionary, http://www.merriam-webster.com/dictionary/pattern, accessed on or about Dec. 16, 2016, 1 pp.

Definition of "pattern," Wikipedia, http://en.wikipedia.org/wiki/Pattern, Wikimedia Foundation,Inc., May 14, 2012, 5 pp.

(56) References Cited

OTHER PUBLICATIONS

Definition of "Uniform," Merriam-Webster Dictionary, http:www.merriam-webster.com/dictionary/uniform, retrieved on Jan. 13, 2017, 2 pp.
Definition of silicone, Wikipedia, http://en.wikipedia.org/wiki/silicone, Oct. 17, 2010, 10 pp.

* cited by examiner

CUT, ABRASION AND/OR PUNCTURE RESISTANT KNITTED GLOVES

REFERENCE TO RELATED APPLICATION

This application is a Divisional application of U.S. application Ser. No. 12/134,862, filed on Jun. 6, 2008, entitled, "CUT, ABRASION AND/OR PUNCTURE RESISTANT KNITTED GLOVES," which claims the benefit of U.S. Provisional Application Ser. No. 60/942,377 filed on Jun. 6, 2007, and entitled "ABRASION AND SLASH RESISTANT KNITTED GLOVES." The entire content of each of these applications is incorporated herein by reference.

FIELD OF THE INVENTION

The invention relates generally to knitted gloves.

BACKGROUND OF THE INVENTION

Conventional fabrics are often easily frayed or damaged when they abrade against the rough surfaces of hard objects such as coarse cement, rocks, and asphalt. Yarns and fibers, especially on the surface of fabrics tend to abrade, lose mass, or even melt due to the heat of friction when exposed to relatively high abrasion conditions.

High-performance fabrics have been developed for some abrasion applications. One approach is to tightly weave or knit high denier yarn (e.g. nylon, polyester, etc.) into a fabric. Thermoplastic coatings can be applied to such fabrics to enhance abrasion resistance. Various high strength fibers (e.g. Kevlar®, PBO, steel, glass, Dyneema®) are sometimes used in high performance fabrics. However, these high strength fibers tend to be brittle, and therefore, are not associated with exceptional abrasion performance in many applications.

Further, many current high performance or abrasion resistant fabrics are bulky, stiff and expensive. Moreover, many abrading objects have sharp or pointed features (e.g. tree branches or rocks) that can snag the fabric and cause failure from tearing or puncturing.

HDM manufactures and sells sheets of SuperFabric® brand material that provide slash and abrasion resistance through the use of hard plates screen printed onto and affixed to the surface of a fabric in a closely spaced geometric pattern. This material is made into gloves by die cutting parts from the sheets and sewing or bonding the parts onto a glove. This results in a glove with excellent cut and abrasion resistance. However, this glove manufacturing method can be inefficient.

Gloves are often made from a knitting process. Rubber dots are sometimes printed onto knitted gloves to improve their grip properties. However, the material used in these dots is purposely chosen to be a relatively soft material since this gives the best grip enhancement for many applications. These soft rubber dots, however, provide little if any puncture or cut resistance. Moreover, when soft rubber dots are used, the abrasion resistance is not improved enough for practical applications where hard abrading objects can cut into and damage the material of the rubber dot.

SUMMARY OF THE INVENTION

The invention is an improved protective knitted glove assembly. One embodiment of the invention includes a knitted glove and two or more non-coplanar arrays of printed guard plates. The guard plates are small, regularly-spaced, generally uniform thickness, non-overlapping, hard polymer material members arranged in a predetermined pattern having an area parallel to a surface of the glove with major and minor dimensions. The major dimension to minor dimension aspect ratio of the guard plates is between about 3 and 1. The overall abrasion resistance of the glove assembly is substantially greater than an abrasion resistance of the knitted glove without the guard plates.

DETAILED DESCRIPTION OF THE PREFERRED EMBODIMENTS

Figure 1A:
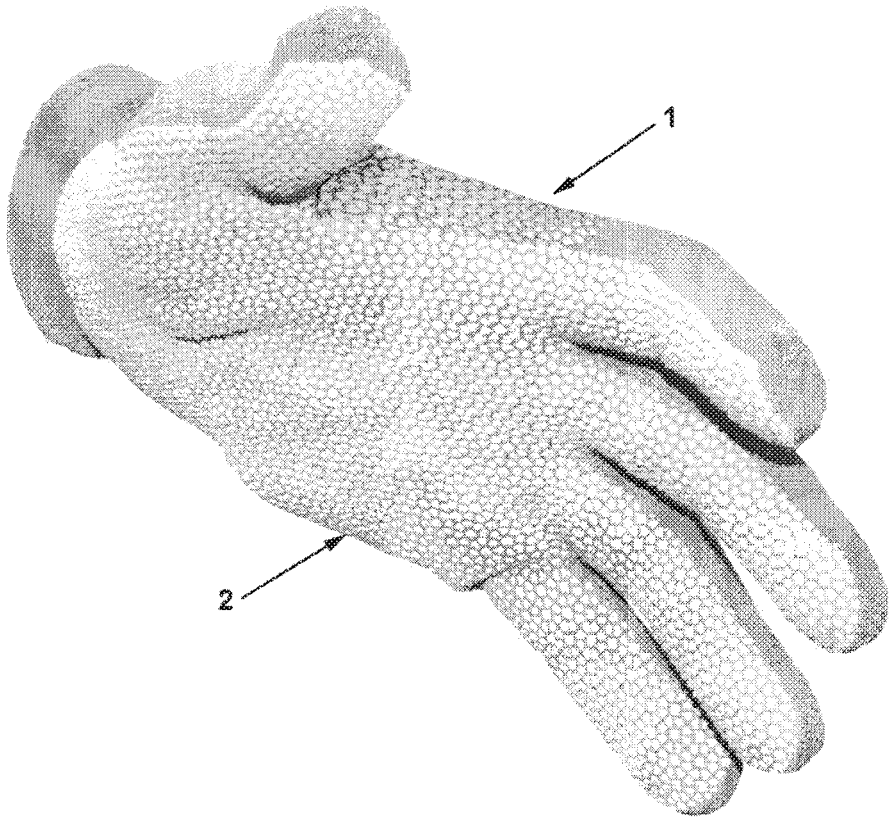
FIG. 1A is an isometric view of a knitted glove with printed protective plates in accordance with one embodiment of the invention, generally showing the palm, the side of the forefinger facing the thumb, and the thumb crotch surface portions of the glove.
Figure 1B:
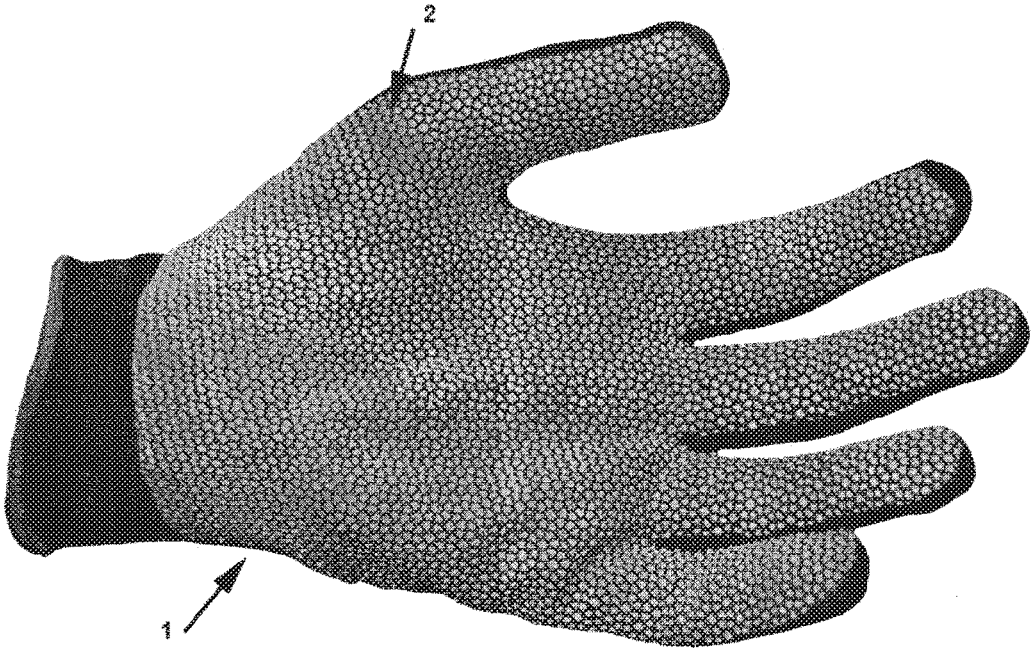
FIG. 1B is an isometric view of the knitted glove shown in FIG. 1A, generally showing the palm side of the glove.
Figure 1C:
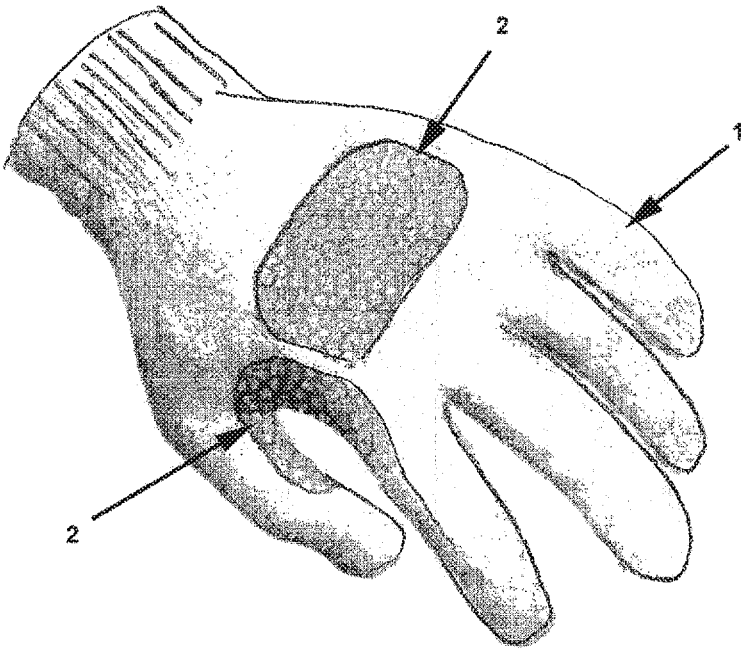
FIG. 1C is an isometric view of the knitted glove shown in FIG. 1A, generally showing the back and thumb crotch surface portions of the glove.

FIG. 1A shows a front view of one embodiment of the glove assembly of the present invention where guard plates 2 between the thumb and forefinger region are visible. As shown in FIG. 1A, guard plates 2 cover the generally planar palm side of the glove assembly 1, including the palm side of the fingers. The portion of the glove assembly 1 with guard plates 2 between the thumb and forefinger is effectively on the side of the forefinger and in the crotch between the forefinger and thumb, surfaces that are effectively non-coplanar and non-parallel with the guard plates on the palm of the glove assembly. The edges of the guard plates 2 on the side of the forefinger and in the thumb crotch are positioned adjacent to the edges of the guard plates on the palm. FIG. 1B shows the palm side of glove assembly 1. FIG. 1C shows glove assembly 1 from the side of the back of the hand. An array of guard plates 2 is shown on the sides of the thumb and forefinger and in the crotch of the forefinger and thumb. Another array of guard plates 2 is shown on the back of the glove assembly 1. The guard plates 2 on the sides of the thumb and forefinger and in the crotch of the thumb are non-coplanar and non-parallel with the guard plates 2 on the back of the glove assembly 1.

Figure 2A:
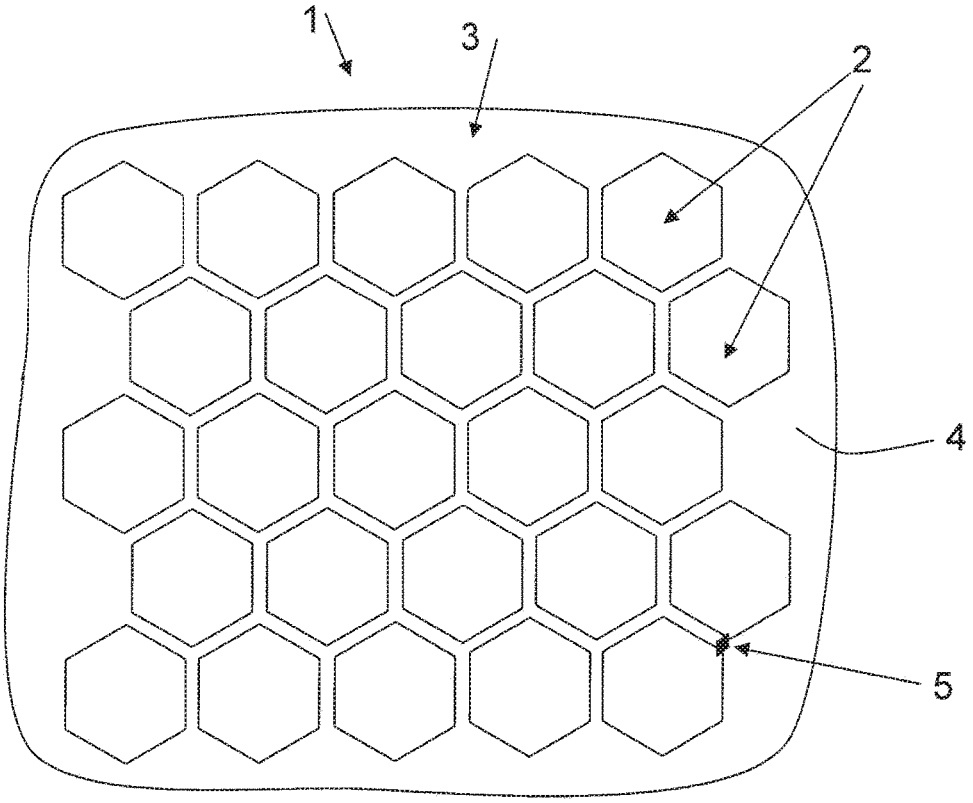
FIGS. 2A-2C show various views of an example of a protective material comprising hexagonal plates attached to a flexible knitted substrate of the glove.
Figure 8A:
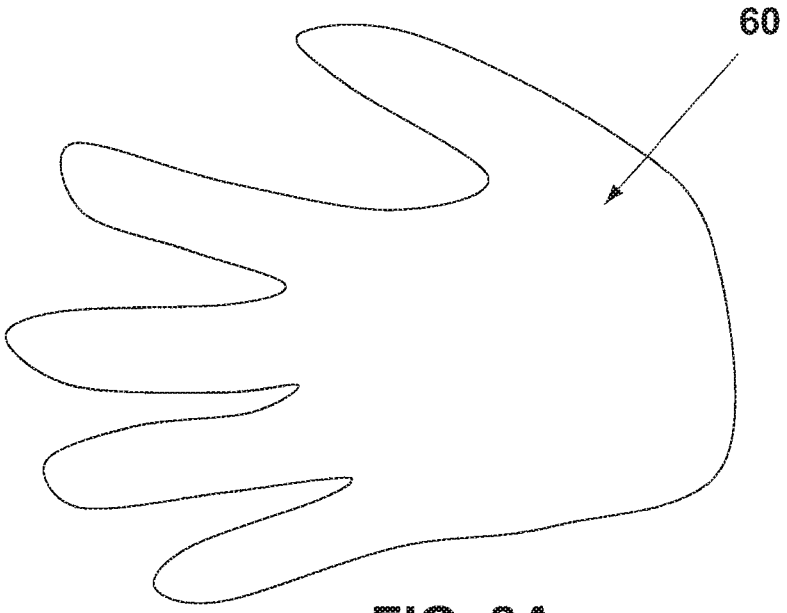
FIG. 8A shows a knitted glove that can be used in connection with the invention.
Figure 9:
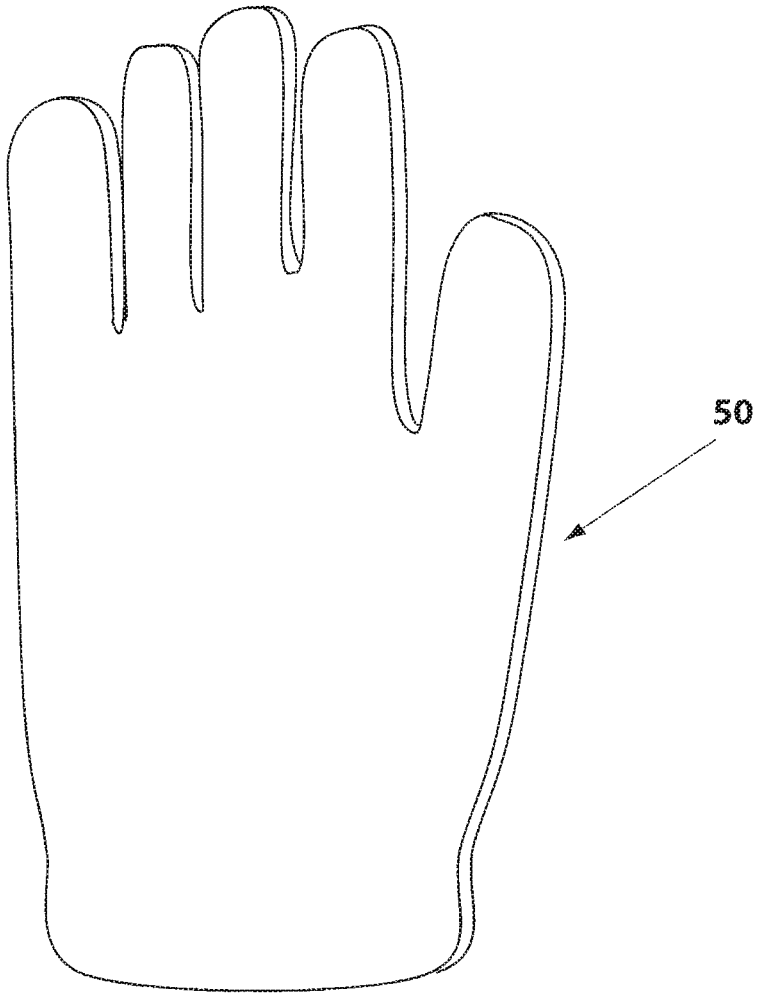
FIG. 9 shows a top view of a glove former that can be used in connection with the invention.

FIG. 2A is a detailed view of a portion of an array of guard plates 2 in accordance with one embodiment of the invention. As shown, a plurality of plates 2 is affixed to the knitted glove fabric 3. The plates 2 are printed onto the outer surface 4 of the knitted glove fabric 3 using standard screen printing processes after placing the knitted glove over a generally planar former plate 50 such as that shown in FIG. 9. The former plate 50 shown in FIG. 9 is generally hand-shaped and can be used as a base for printing guard plates 2 on the palm and back sides of the knitted glove 3 such as that shown in FIG. 8A. The former plate 50 is chosen so that the glove 3 fits snuggly on the former. The resin used to form guard plates 2 is chosen to have a rheology suitable to screen printing and to have cured properties suitable to providing protective properties. The plurality of plates 2 enhances the abrasion, wear, and cut resistance of glove 3. The resistance of glove 3 to puncture by nails or items of similar dimension is also enhanced by the plurality of plates 2. Puncture resistance to smaller diameter objects, such as hypodermic needles, can be enhanced by using multiple layers of guard plates 2 or multiple layers of fabric substrates with the guard plates. For example a two layer glove assembly can be made by taking two gloves and stretching one over the other. A slightly larger outer layer glove can be used to prevent excessive stretching from causing too tight a fit. Three, or even more, layers could be used similarly.

Depending on application, abrasion resistance can range from low intensity rubbing typical of gloves repeatedly worn and laundered, to high intensity abrasion (high loading and/or high speed) such as for gloves worn to provide protection in, for example, motorcycle riding. It is noted that the fabrics of the present invention can be heat resistant, which is meant to include fabrics that are relatively heat tolerant and heat insulating.

Adding cut resistant plates 2 to the gloves 3, as is done in this invention, will substantially improve the cut resistance and other mechanical properties. The cut resistance can be further increased by adding hard fillers, such as ceramic beads or glass beads, to the resin used to construct the plates 2. Also the thickness of the plates can be adjusted to provide a balance between overall glove weight and the desired level of slash resistance.

The present invention is an alternative way of making gloves that incorporate the essential features of SuperFabric® technology without the processing costs associated with making SuperFabric® sheets into gloves. These gloves are made by printing guard plates 2 directly onto the surface of a finished knitted or woven glove 3. The resulting glove assembly 1 has comparable abrasion resistance to gloves made from SuperFabric® sheets without the extra costs associated with sewing in the SuperFabric® patches. Although in some embodiments there may be some modest reduction in cut resistance due to the stretchability of the knitted glove, the gloves of the present invention offer improved comfort compared to typical gloves made from SuperFabric® sheets because of this stretchability afforded by the knitted substrate.

In one embodiment of the present invention, cut resistant plates 2 are used with a sufficiently tight gap that it is improbable or impossible for a blade to slash through the glove without cutting the plates. In another embodiment, wear resistant plates 2 are used and these can dramatically improve the lifetime of the glove. Additionally, a relatively soft dot (not shown) can be printed on top of the cut-resistant 2 plates for enhanced grip properties if desired. Alternatively, a dip coating can be applied over the plates 2. However, for some applications, the surface properties of the hard plates 2 may be preferred.

In one embodiment of the present invention, the base fabric of the knitted gloves 3 is nylon. In other embodiments, polyester, aramid, ultra high molecular weight polyethylene or blends of these materials are used. In still another embodiment, the base fabric comprises a blend of aramid and thin steel wires.

Figure 3:
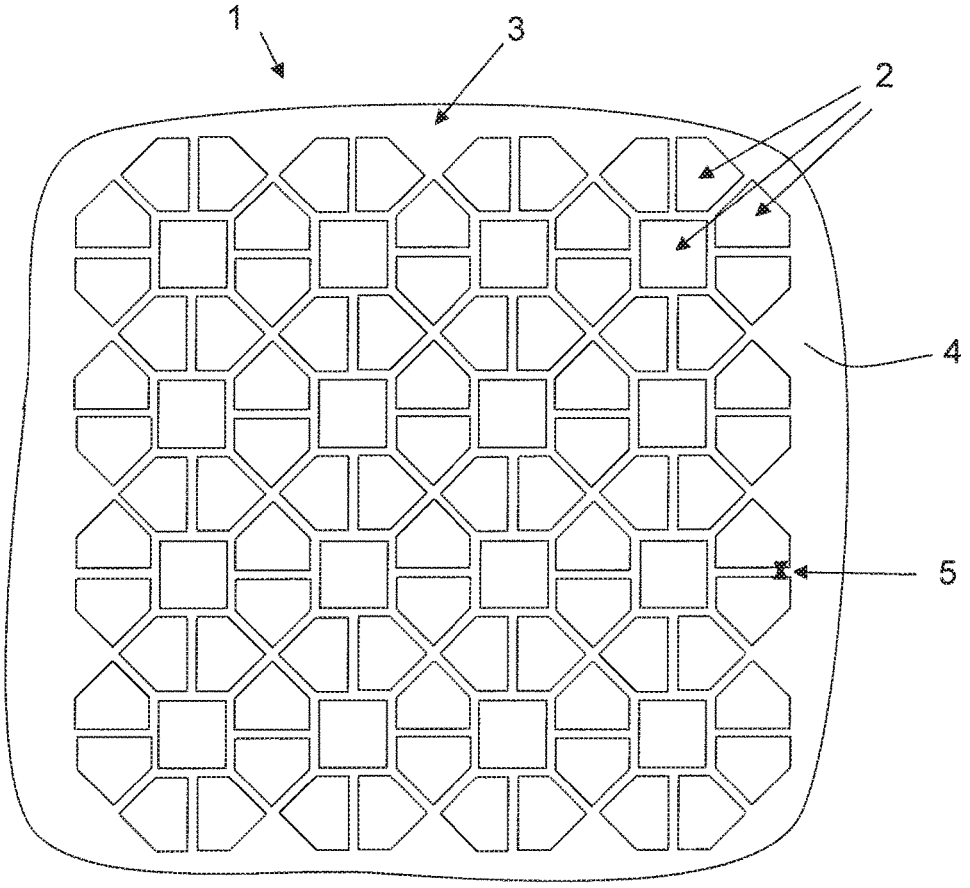
FIG. 3 shows an example of a protective material comprising square and pentagonal plates with relatively tight gaps attached to a flexible knitted substrate of the glove.
Figure 4:
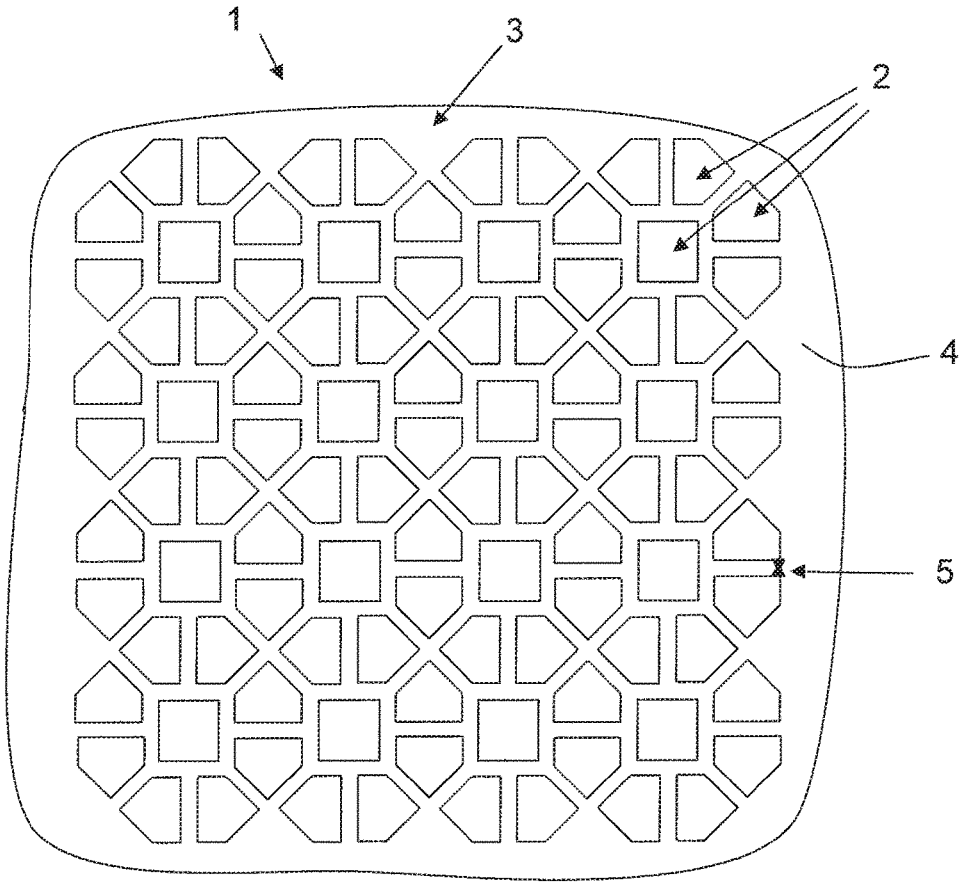
FIG. 4 shows an example of a protective material comprising square and pentagonal plates with relatively wide gaps attached to a flexible knitted substrate of the glove.
Figure 5:
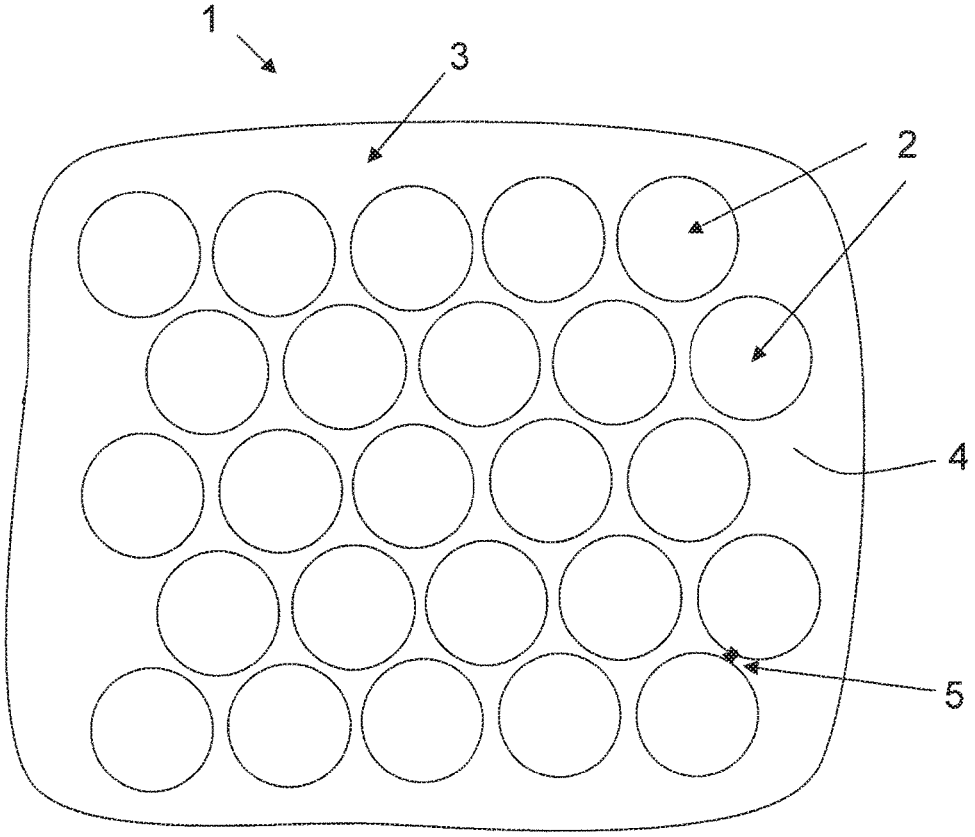
FIG. 5 shows an example of a protective material comprising circular plates attached to a flexible knitted substrate of the glove.

FIGS. 3, 4 and 5 illustrate alternative geometries for the plates 2. FIG. 3 shows a pattern having pentagons and squares. FIG. 4 is a similar pattern but with larger gaps. The gaps 5 between the plates 2 in FIG. 4 are still small enough that a blade can not penetrate the glove 3 for a significant distance without cutting through guard plates 2. This allows the printed glove assembly 1 to have significantly enhanced cut resistance as well as abrasion resistance. FIG. 5 shows an alternative embodiment with circular plates.

Having rigid plates with tight gaps 5 as shown in FIG. 2A may reduce the overall stretchability of the glove assembly 1. The glove assembly 1 can however be re-designed so that it fits the appropriate sized hand after the printing operation. So, for example, a glove 3 that was originally designed for a large sized hand might fit a medium sized hand well after it is made into a glove assembly 1 by printing with rigid plates 2. In one embodiment, only certain areas of the glove 3 are covered with guard plates 2 and the non-covered areas allows for stretchability.

Plurality of plates 2 are non-overlapping and are arrayed and affixed on the outer surface 4 of the knitted glove 3. Plates 2 define a plurality of gaps 5 between adjacent plates 2. Gaps 5 are continuous and inter-linking and each has a selected width so that the glove assembly 1 retains flexibility while simultaneously inhibiting objects from abrading directly against and degrading the glove's substrate 3. The glove 3 can be printed in several stages. For example, after a glove such as 3 is placed on a former plate such as 50, plates 2 can be printed on the opposite sides during separate printing steps. The gaps 5 between the plates 2 can be significantly smaller than the largest plate dimension when the gloves are in the unstretched state.

Figure 2B:
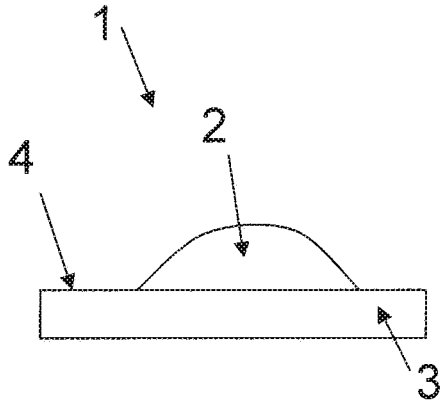
Figure 2C:
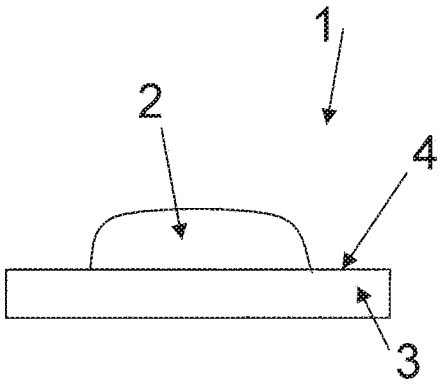

FIGS. 2A, 3, 4 and 5 illustrate various plate 2 dimensions and patterns that can be selected for a desired abrasion, cut and/or puncture resistance. Plates 2 have an approximately uniform thickness (shown on FIGS. 2B and 2C) that is in the range of 4 to 40 mils in some embodiments. In other embodiments, plates 2 have an approximately uniform thickness in the range of 4 to 20 mils. It is important to note that although plates 2 can be shaped as identical regular hexagons, plates 2 can be embodied in any regular or non-regular shape, and be identical or non-identical to one another. In some embodiments, the maximum dimension is in the range of 20 to 200 mils for any plate shape, including hexagonal.

For example, plates 2 can have any polygonal shape such as a square, rectangle, octagon, or a non-regular polygon shape. Plates 2 can also have any curved shape such as a circle, ellipse, or a non-regular curved shape. Plates 2 can also be embodied as a composite shape or combination of any regular or non-regular polygon and/or any regular or non-regular curved shape.

In one embodiment of the present invention the ratio of the major dimension of the guard plate 2 to the minor dimension of the guard plate is between 1 and about 3. This is a preferred range, because horizontal aspect ratios greater than about 3 may result in plates that are more prone to cracking and are more prone to creating too much stress on the fabric. In other embodiments of the invention the guard plates 2 can have horizontal aspect ratios outside this range.

In one embodiment of the present invention the ratio of the major dimension of the guard plate to the thickness the guard plate is between 3 and about 10. This is a preferred range, because vertical aspect ratios greater than about 10 would result in plates that are more prone to cracking and vertical aspect ratios less than about 3 would be difficult to produce in a screen printing operation. In other embodiments of the invention the guard plates 2 can have vertical aspect ratios outside this range.

Gaps 5 are continuous due to the non-overlapping characteristics of plates 2. Gaps 5 also have a width that can be approximately uniform or non-uniform. However, generally, the gap 5 width is in the range of approximately 4 to 20 mils, which is the same range provided for plate thickness. In other embodiments, both gap 5 width and plate thickness is in the approximate range of 4 to 40 mils. The co-extending ranges for gap 5 width and plate thickness have been found to be an appropriate compromise between adequate flexibility and adequate mechanical strength against outside forces (i.e. abrasion, wear, cut and tear resistance) as well as providing optional heat resistance. Other embodiments of the invention have dimension outside these ranges.

As noted above, the knitted gloves can be printed by mounting the gloves on a flat hand former 50 such as that shown in FIG. 9 and then screen printing resin onto the gloves in a flat-bed screen printing operation. Tack can be applied to the former 50 in order to prevent the glove 3 from pulling up from the former during the printing operation. In some embodiments, the former is chosen to have an extended shape so that when the printed glove 1 is removed from the former, guard plates 2 will be present on the sides of the glove. The former 50 shown in FIG. 9 has widened pinky and thumb areas for this purpose. For example, FIG. 1A shows a knitted glove 3 with guard plates 2 on the side of the small finger (i.e. pinky) extending down the side of the hand. This is achieved by using a wide area pinky in the former 50 which causes some of the fabric making up the side of the glove 3 to be stretched into place on the top surface of the former and therefore printed during the screen printing step. Using wide areas in the formers can give a 3-D effect when the guard plates 2 are cured since this tends to hold one surface in a stretched out configuration which results in curved shapes. This is most noticeable in the fingers which tend to become rounded. This 3-D shaping can give a more comfortable glove fit.

In some embodiments of the invention, a second, third or even more screen printing stages or steps are applied. As shown in the embodiment of glove assembly 1 illustrated in FIGS. 1A-1C, for example, it is sometimes desirable to have guard plates 2 on the back side or some portion of the back side of the glove. When the back of the glove 3 is to be printed, the second printing can take place on the same former 50 by simply rotating the former 180 degrees and then applying the second printing step. If the glove 3 needs to be removed from the first former 50 and placed onto a second former for the second printing (e.g., as would be the case for printing between the thumb and forefinger area as described below), it is generally preferable to pre-cure the first array of guard plates 2 before removing the glove from the first former. The glove 3 would then be placed over the second former and the second screen printing would be applied.

Figures 7A, 7B, 7C:
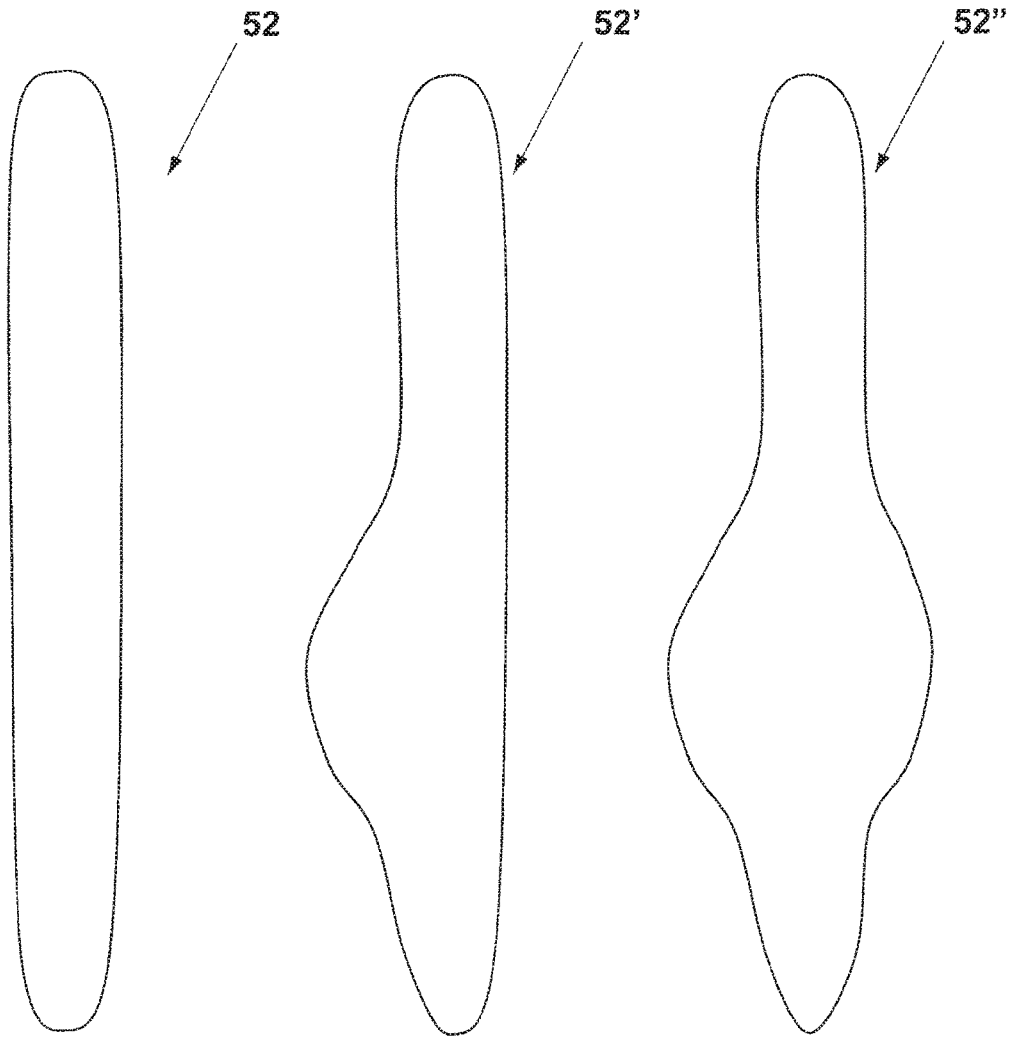
FIG. 7A shows a top view of a secondary former used in connection with one embodiment of the invention to make an array of guard plates on the side of the glove shown in FIG. 1A between the forefinger and the thumb.
FIG. 7B shows an alternative secondary former that allows for additional coverage beyond that of the former shown in FIG. 7A.
FIG. 7C shows another alternative former that allows for still more coverage beyond that of the former shown in FIG. 7B.
Figure 8B:
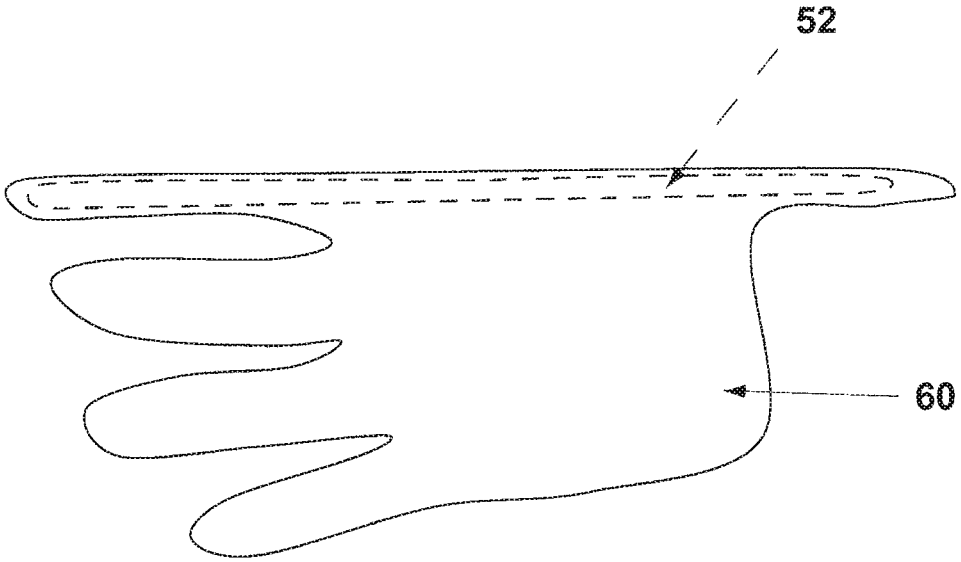
FIG. 8B shows the knitted glove of FIG. 8A mounted to the former shown in FIG. 7A.

In some embodiments such as those shown in FIGS. 1A-1C, the area on the side of the glove 3 between the thumb and the forefinger is printed in a secondary printing step where an appropriately shaped former is used to stretch the area of the glove 3 extending from the thumb through the forefinger area into a flat surface. When screen printing a glove 3 mounted to such a former, a second array of guard plates is created that is non-coplanar with the first printed array of guard plates. An example of a former 52 that can be used for this purpose is shown in FIG. 7A. One end of this former 52 can be inserted into the forefinger of the glove 3 and the thumb of the glove can then be stretched over the other end of the former. The former 52 thereby provides a flat area on which a screen printing operation can be carried out to form guard plates 2 that will be located on the sides of the fingers. FIGS. 8A and 8B show an un-mounted glove 60 and the glove 60 mounted on the former of FIG. 7A, respectively. As shown in FIG. 8B, the former 52 provides a generally planar surface perpendicular to the palm of the glove 60 between the tips of the thumb and forefinger. The appropriate shape for this former 52 will vary with the size of the glove. In one embodiment, the shape of the former 52 is a rectangular shape with rounded ends having a length of about 6"-12" and a width of about 0.5" to 1.5". In other embodiments (shown in FIGS. 7B and 7C), the shape of this former (52' and 52") is bulged out in the thumb crotch area (the area between the thumb and the forefinger) in order to give extended coverage in that area. In some embodiments it is difficult to stretch the glove 60 so that the forefinger and thumb fit over the former. In these cases the former can be made in two or more pieces (not shown) that can attach together after the parts are placed into the glove. When more than one printing step is used to manufacture the glove assembly 1 having non-coplanar arrays of guard plates 2, the guard plates formed during each individual printing step can be pre-cured after those steps. The guard plates 2 can then be exposed to heat, or UV radiation, or otherwise cured, during a final curing step.

Embodiments having guard plates 2 in the thumb though forefinger area are shown in FIGS. 1A and 1C. The guard plates in these embodiments are located in the thumb crotch region, but in other embodiments the guard plates can extend the full length between the thumb and the forefinger.

Figure 6A:
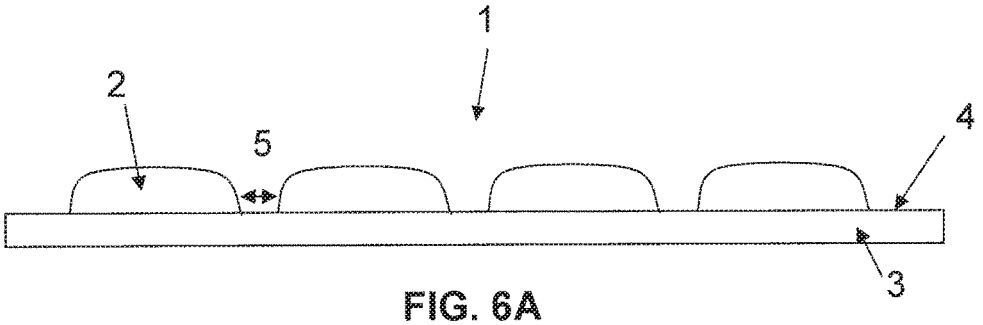
FIG. 6A shows a side view of protective plates attached to a knitted substrate of the glove.
Figure 6B:
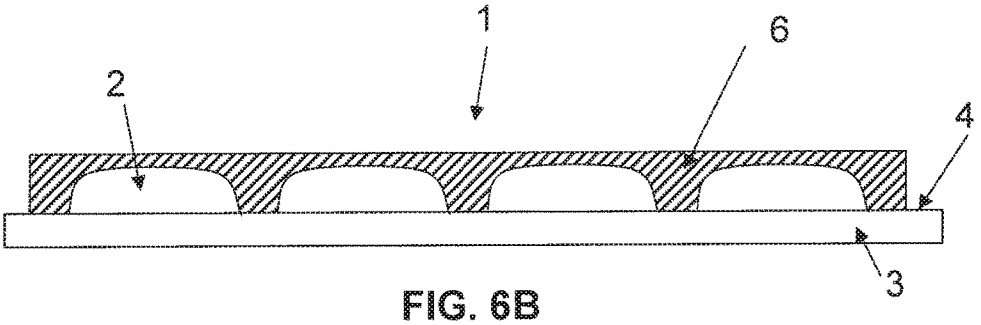
FIG. 6B shows an embodiment of the invention having a layer of an elastomer over the tops of the plates and substrate of the material shown in FIG. 6A.

The glove assembly 1 can be given a 3-D shape to improve comfort by printing the glove on a flat former (such as 50 and 52), only partially curing the resin while it is on the flat former, then removing the glove from the flat former and placing it on a former (not shown) having a 3-D shape corresponding to the desired shape of the portion of the glove with the plates 2 (e.g., hand-shaped). Upon fully curing the resin at least, some of the 3-D shape can be retained by the glove assembly 1. This 3-D effect can alternatively be created by using a dipping operation where nitrile, polyurethane or some other elastomer is applied to the glove assembly 1 while the glove is on a 3-D former (not shown). Curing the elastomer while on the former causes the 3-D shape to be retained by the glove assembly 1. In embodiments where an elastomer is applied, the final full cure of the resin can be carried out before or after the dipping operation. FIG. 6A shows a side view of plates 2 attached to a substrate 3. FIG. 6B shows a layer of an elastomer 6 applied over the tops of the plates 2 as an example of this embodiment of the invention.

Abrasion is a complex phenomenon or process and is influenced, for examples, by the types of materials that are being abraded, the surface characteristics, the relative speed between surfaces, lubrication, and the like. There exist many standardized abrasion tests designed to reflect many varied abrasion conditions. One typical test is the ASTM D 3884. In this test, two round-shaped wheels with specified surface characteristics apply pressure and rotate on the surface of the test sample with a given speed under a predetermined load (e.g. up to 1000 g). Test results are given either as the number of cycles for the fabric to wear through or as the fabric's weight loss after a fixed number of cycles.

Unfortunately, standardized abrasion tests are often limited due to the limited loading level and speed that can be applied against test fabric. Due to these limitations, other tests are developed to more closely simulate real world conditions. For example, one test can comprise washing gloves continuously in a washing machine containing rocks. In another example, gloves can be wrapped around a concrete weight and thrown from a speeding vehicle in order to test gloves suitable for wear by motorcycle riders and the like.

In some embodiments, the affixed plates enhance the abrasion and wear resistance of the base glove fabric by a enhancement factor F. An enhancement factor F is the ratio of abrasion and/or wear resistance of the fabric assembly of the glove to that of the knitted fabric. Thus, for example, assuming the abrasion resistance of the flexible substrate is 50 cycles on a Taber test and the abrasion resistance of the composite knit glove assembly is 500, then the enhancement factor is given by F=10. It is noted that the enhancement factor F can be the ratio of any measurement that is associated or correlated with abrasion and/or wear resistance.

The enhancement factor can be influenced by selecting various substrate fabrics, guard plate shape and dimensions such as thickness, gap width, plate diameter or maximum dimensions. The enhancement factor can generally range from 2 to 200 depending on various selections made. In other embodiments, the enhancement factor can range from 3 to 100, 3 to 10, 10 to 50, and 12 to 30, respectively.

The present invention offers a number of advantages over known gloves such as those having printed rubber material dots on the knitted gloves. One major improvement of the present invention is the increase in both abrasion resistance, cut and puncture resistance from using a geometry where the gaps between plates are smaller than the largest plate dimension. Using smaller gaps will generally enhance abrasion resistance since a larger area of the fabric will be covered. Using gaps sufficiently small that extended straight lines between plates are avoided improves both the abrasion and slash resistance since it will reduce the chances of any sharp edges penetrating the fabric. Using a gap smaller than likely puncturing object, will provide puncture resistance against those objects. Using multiple layers of the gloves can further enhance the puncture resistance. In some embodiments of the present invention, the width of the gaps, when the glove is unstretched, is between 4 and 75 percent of the size of the largest plate dimension. In other embodiments, the width of the gaps, when the glove is unstretched, is between 4 and 20 percent of the size of the largest plate dimension. In other embodiments of the invention the dimensions can be outside these ranges.

A second major advantage of the present invention is the use of a cut resistant plate. The plates used in the present invention provide slash protection due either to the inherent hardness of the resin used to construct the plate or to hard fillers added to the resin (or from a combination of both effects). Using cut resistant plates increases the real-world abrasion resistance as well as the slash resistance, since the cut resistant plates will prevent sharp edges of rocks, for example, from cutting into the gloves.

In the present invention, the plate material is applied in a wet form and slightly permeates and affixes to outer surface 4. Plate material includes resins such as epoxy resins, phenol-based resins, and other like substances. Such materials can require heat or ultraviolet curing.

Plate materials can be resins such as epoxy or phenol based resins that are capable of being solid or hard. It is generally preferred that plate material has tensile strength higher than about 100 kgf/cm$^2$ (typical epoxy tensile strength when cured of approximately 700 kgf/cm$^2$). It is also generally preferred that the plate hardness be higher than about Shore D 10. In some embodiments, additives can be added to the resins in order to increase abrasion, wear and/or slash resistance when appropriate. Examples of additives include alumina or titanium particles or ceramic or glass beads. Resin materials can also be specifically selected for their heat resistant properties.

In some embodiments of the present invention, an additional layer of plate material can be applied to the outer surface of the printed glove either by a printing operation or by dip coating. This material can be chosen to be polyurethane, nitrile, silicone, plastisol, or other elastomeric material for improved grip properties. In some embodiments the material will go between the gaps in the guard plates to form a bond with the underlying knitted fabric of the base glove layer. In one embodiment, the diameter of the elastomeric material is applied as dots with a diameter between 10 and 500 mils and with gaps between 10 and 500 mils.

In one embodiment of the present invention, plate dimensions are selected so that plate maximum dimension is in the range of approximately 20 to 200 mils. In another embodiment, the plates are shaped as polygons such as equilateral hexagons; curved shapes; or composite shapes arrayed in a pattern with gap widths between adjacent plates in the range of 4 to 100 mils. In another embodiment, the plate thickness is in the range of 4 to 100 mils. In other embodiments, plate thickness and gap width is in the range of 4 to 20 mils. Other embodiments of the invention have other dimensions and features.

It is sometimes desirable to enhance the abrasion and/or resistance of one or more entire glove surfaces. Alternately, abrasion and/or slash enhancement can be limited to selected locations on the glove, such as the fingers area or the palm area. These various print patterns can be achieved by the appropriate selection of a screen in the screen printing operation. The plates formed during the several printing steps can also be positioned sufficiently close to one another as to provide an essentially seamless characteristic.

Another desirable feature of the present inventions is that the glove assembly is considered attractive. The plates can be colored to match or contrast with the glove's fabric substrate. Also, the plates can be arrayed in attractive patterns. It is also possible that plate patterns and/or colors can be selected to form images or lettering due to the small yet discrete characteristics of the affixed plates. The affixed plates can also be made to be heat insulating.

Various embodiments of protective material and methods of manufacturing the protective material that can be used in connection with the gloves described herein are described in commonly owned U.S. Pat. No. 6,962,739, titled SUPPLE PENETRATION RESISTANT FABRIC AND METHOD OF MAKING, filed Jul. 6, 2000, U.S. Pat. No. 7,018,692, entitled PENETRATION RESISTANT FABRIC WITH MULTIPLE LAYER GUARD PLATE ASSEMBLIES AND METHOD OF MAKING THE SAME, filed Dec. 21, 2001, U.S. Patent Application Publication No. 20040192133, entitled ABRASION AND HEAT RESISTANT FABRICS, Ser. No. 10/734,686, filed on Dec. 12, 2003, U.S. Patent Application Publication No. 20050170221, entitled SUPPLE PENETRATION RESISTANT FABRIC AND METHOD OF MAKING, Ser. No. 10/980,881, filed Nov. 3, 2004, and U.S. Patent Application Publication No. 20050009429, entitled FLAME RETARDANT AND CUT RESISTANT FABRIC, Ser. No. 10/887,005, filed Nov. 3, 2004, all herein incorporated by reference in their entirety. The plate printing methods and plate configurations, dimensions and other features shown in these patent documents can be incorporated into the invention described herein.

Although the present invention has been described with reference to preferred embodiments, workers skilled in the art will recognize that changes may be made in form and detail without departing from the spirit and scope of the invention.

What is claimed is:

1. A method for making a protective knitted glove assembly, the method including:

placing a first portion of a knitted glove on a substantially planar surface;

screen printing onto the first portion of the knitted glove a first array of regularly-spaced, substantially uniform thickness, non-overlapping, polymer material guard plates arranged in a predetermined pattern;

placing a second portion of the knitted glove that is non-coplanar with the first portion on a substantially planar surface;

screen printing onto the second portion of the knitted glove a second array of regularly-spaced, substantially uniform thickness, non-overlapping, polymer material guard plates arranged in a predetermined pattern, wherein the second array of guard plates is non-coplanar with the first array of guard plates, wherein the second array of guard plates are non-overlapping with the first array of guard plates; and curing the polymer material to harden the guard plates, wherein curing the polymer material includes only partially curing the polymer material of the first array of guard plates before screen printing the second array of guard plates; and fully curing the polymer material of the first array and the partially cured second array after screen printing the second array of guard plates.

2. The method of claim 1, wherein:

placing a first portion of a knitted glove on the substantially planer surface includes placing at least a portion of a palm side of the glove on the substantially planer surface;

screen printing onto a first portion of the knitted glove includes screen printing the first array of guard plates onto at least a portion of a palm side of the knitted glove on the substantially planer surface;

placing a second portion of the knitted glove on the substantially planer surface includes placing at least a portion of a side of one or more fingers on the substantially planer surface; and screen printing onto a second portion of the knitted glove includes screen printing the second array of guard plates onto at least a portion of a side of a finger of the glove on the substantially planer surface.

3. The method of claim 2, wherein:

placing at least a portion of a side of one or more fingers on the substantially planer surface includes placing a former between the thumb and forefinger with at least a portion of the sides of the thumb and forefinger on a planar surface of the former; and screen printing the second array of guard plates includes screen printing guard plates onto at least a portion of the sides of the thumb and forefinger.

4. The method of claim 3, wherein screen printing the second array of guard plates includes screen printing guard plates onto at least a portion of a crotch between the thumb and forefinger.

5. The method of claim 3, further including:

placing at least a portion of a back of the glove on the former; and screen printing an array of regularly-spaced, generally uniform thickness, non-overlapping, polymer material guard plates arranged in a predetermined pattern on at least a portion of the back of the glove.

6. The method of claim 1, further including placing at least a portion of the glove having the guard plates on a three dimensional former before finally curing the guard plates.

7. The method of claim 1, further including applying elastomeric material over at least a portion of the arrays of guard plates.

* * * * *